US010077652B2

(12) United States Patent
Ortiz et al.

(10) Patent No.: US 10,077,652 B2
(45) Date of Patent: Sep. 18, 2018

(54) MUD PULSER WITH HIGH SPEED, LOW POWER INPUT HYDRAULIC ACTUATOR

(75) Inventors: Ricardo Ortiz, Houston, TX (US); Mark Sitka, Richmond, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 118 days.

(21) Appl. No.: 14/364,913

(22) PCT Filed: Sep. 4, 2012

(86) PCT No.: PCT/US2012/053610

§ 371 (c)(1),
(2), (4) Date: Jun. 12, 2014

(87) PCT Pub. No.: WO2014/039025

PCT Pub. Date: Mar. 13, 2014

(65) Prior Publication Data

US 2014/0340991 A1 Nov. 20, 2014

(51) Int. Cl.
*E21B 47/12* (2012.01)
*E21B 47/18* (2012.01)

(52) U.S. Cl.
CPC ..... *E21B 47/18* (2013.01); *E21B 47/182* (2013.01); *E21B 47/12* (2013.01); *E21B 47/185* (2013.01); *E21B 47/187* (2013.01)

(58) Field of Classification Search
CPC ..... E21B 47/12; E21B 47/18; E21B 47/182; E21B 47/185; E21B 47/187
USPC ..... 367/81, 83, 84
See application file for complete search history.

(56) References Cited

U.S. PATENT DOCUMENTS 3,393,610 A 7/1968 Aarvold
4,265,434 A * 5/1981 Hamilton ..... B25B 5/061 269/27
4,313,367 A 2/1982 Weyer
4,603,616 A 8/1986 Zajac
(Continued)

OTHER PUBLICATIONS

Parker, "Hydraulic Rotary Actuators", dated Nov. 2004, 167 pages.
(Continued)

*Primary Examiner* — Hai Phan
*Assistant Examiner* — Franklin Balseca
(74) *Attorney, Agent, or Firm* — Chamberlain Hrdlicka

(57) ABSTRACT

A method of modulating information on pressure fluctuations transmitted via a tubular string can include applying pressure to a piston, thereby axially displacing the piston, axially displacing and rotating an intermediate sleeve in response to the piston displacement, rotating an output member in response to the axial displacement and rotation of the intermediate sleeve, and rotating a variable flow restrictor rotor relative to a stator, the rotor being connected to the output member. A mud pulser can include a variable flow restrictor, and an actuator which operates the flow restrictor and modulates information on pressure fluctuations produced by the flow restrictor, the actuator including a piston which displaces axially in response to a pressure differential, an intermediate sleeve which is both rotated and displaced axially by the piston, and an output member which is rotated by both rotation and axial displacement of the intermediate sleeve.

27 Claims, 8 Drawing Sheets

(56) References Cited

U.S. PATENT DOCUMENTS

| | | | | |
|---|---|---|---|---|
| 4,667,528 | A * | 5/1987 | Weyer | B60G 21/0553 74/89.24 |
| 4,741,250 | A | 5/1988 | Weyer | |
| 4,772,849 | A | 9/1988 | Tedder | |
| 5,119,344 | A * | 6/1992 | Innes | E21B 47/182 367/84 |
| 5,671,652 | A * | 9/1997 | Weyer | F15B 15/06 92/107 |
| 6,469,637 | B1 | 10/2002 | Seyler et al. | |
| 6,714,138 | B1 | 3/2004 | Turner et al. | |
| 7,243,574 | B2 | 7/2007 | Biester | |
| 2005/0252316 | A1 | 11/2005 | Biester | |
| 2008/0055110 | A1 | 3/2008 | Hahn et al. | |
| 2009/0032245 | A1 | 2/2009 | Zupanick | |
| 2011/0198126 | A1 | 8/2011 | Swietlik et al. | |

OTHER PUBLICATIONS

International Search Report and Written Opinion dated Mar. 8, 2013 for PCT Patent Application No. PCT/US2012/053610, 12 pages.

* cited by examiner

MUD PULSER WITH HIGH SPEED, LOW POWER INPUT HYDRAULIC ACTUATOR

CROSS-REFERENCE TO RELATED APPLICATION

This application is a national stage under 35 USC 371 of International Application No. PCT/US12/53610, filed on 4 Sep. 2012. The entire disclosure of this prior application is incorporated herein by this reference.

TECHNICAL FIELD

This disclosure relates generally to equipment utilized and operations performed in conjunction with a subterranean well and, in one example described below, more particularly provides a mud pulser with a high speed and low power input hydraulic actuator.

BACKGROUND

A mud pulser is used to generate pressure fluctuations in fluid (such as drilling mud) flowing through a tubular string (such as a drill string). The pressure fluctuations are varied by the mud pulser to thereby modulate data and/or command information on the pressure fluctuations.

It will be appreciated that improvements are continually needed in the arts of constructing and operating mud pulsers and otherwise modulating data on pressure fluctuations transmitted via tubular strings.

DETAILED DESCRIPTION

Figure 1:
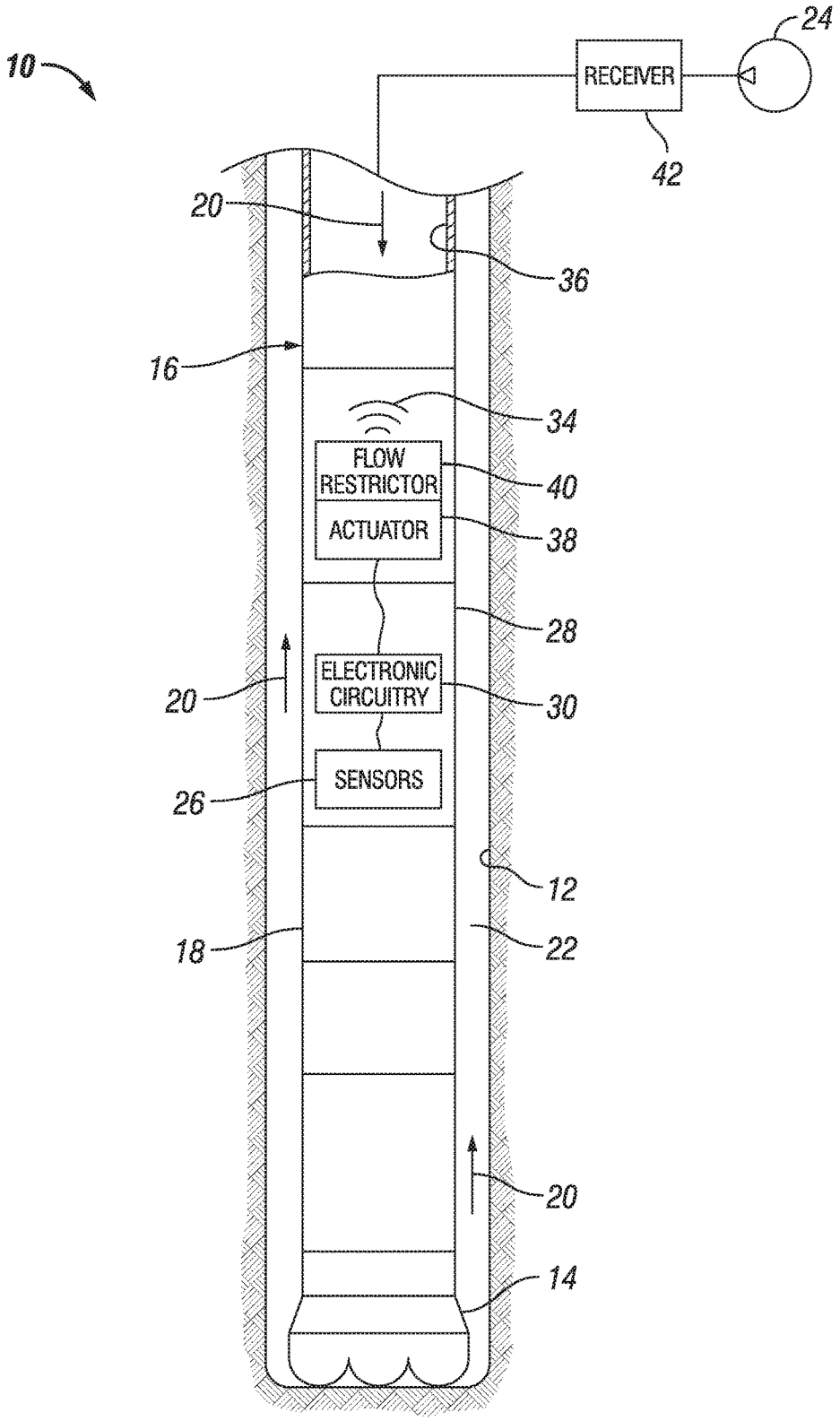
FIG. 1 is a representative partially cross-sectional view of a well system and associated method which can embody principles of this disclosure.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the system 10, a wellbore 12 is drilled by rotating a drill bit 14 at an end of a tubular string 16. A drilling motor 18 (such as, a Moineau-type positive displacement motor, a turbine, etc.) may be used to rotate the drill bit 14, and/or the tubular string 16 may be rotated by a rotary table, top drive, etc. at or near the earth's surface.

In this example, the tubular string 16 is a drill string used for drilling the wellbore 12, but it should be clearly understood that the scope of this disclosure is not limited to use in drilling operations or with drill strings. In other examples, the tubular string 16 could be used in injection or stimulation operations, completion operations, or other operations.

In the system 10 of FIG. 1, a fluid 20 (such as drilling mud) is circulated through the tubular string 16, exits nozzles in the drill bit 14, and returns to the surface via an annulus 22 formed between the tubular string and the wellbore 12. The fluid 20 is pumped by a rig mud pump 24 at the surface.

The tubular string 16 includes various sensors 26, which are depicted in FIG. 1 as being included in a measurement-while-drilling (MWD) and/or a logging-while-drilling (LWD) and/or a pressure-while-drilling (PWD) tool 28 interconnected in the tubular string 16. The sensors 26 may be any type of sensors used for measuring well parameters, such as, pressure, temperature, inclination, azimuth, gamma counts, resistivity, nuclear magnetic resonance, torque, weight on bit, rotational speed (RPM), stick-slip, etc. The scope of this disclosure is not limited to any particular type of downhole sensor, to use of a MWD/LWD/PWD tool 28, or to use of a downhole sensor at all.

In the FIG. 1 example, measurements or indications taken by the sensors 26 are monitored/recorded by electronic circuitry 30. This information is put in a suitable format by the electronic circuitry 30 for transmission to the surface by a mud pulser 32.

The mud pulser 32 produces pressure fluctuations 34 in the fluid 20 as it flows through an internal flow passage 36 extending longitudinally through the tubular string 16. The pressure fluctuations 34 are produced by an actuator 38 causing a variable flow restrictor 40 to intermittently restrict the flow of the fluid 20 through the passage 36.

As described more fully below, the actuator 38 operates the flow restrictor 40, so that information is modulated on the pressure fluctuations 34. This modulation may be of any type, including (but certainly not limited to) frequency shift keying, phase shift keying, differential pulse position modulation, etc. Any modulation technique may be used, in keeping with the scope of this disclosure.

The pressure fluctuations 34 are detected at the surface by a receiver 42 (for example, including a pressure sensor), and the information modulated on the pressure fluctuations is decoded. In some examples, the receiver 42 could instead, or in addition, include a transmitter for producing pressure fluctuations to be transmitted downhole, in which case a receiver may be included in the tubular string 16. Thus, the scope of this disclosure is not limited to transmission of sensor data to the surface, since transmission of other types of information (such as commands, etc.) can be performed, and the information may be transmitted in any direction via the pressure fluctuations 34.

Figure 2:
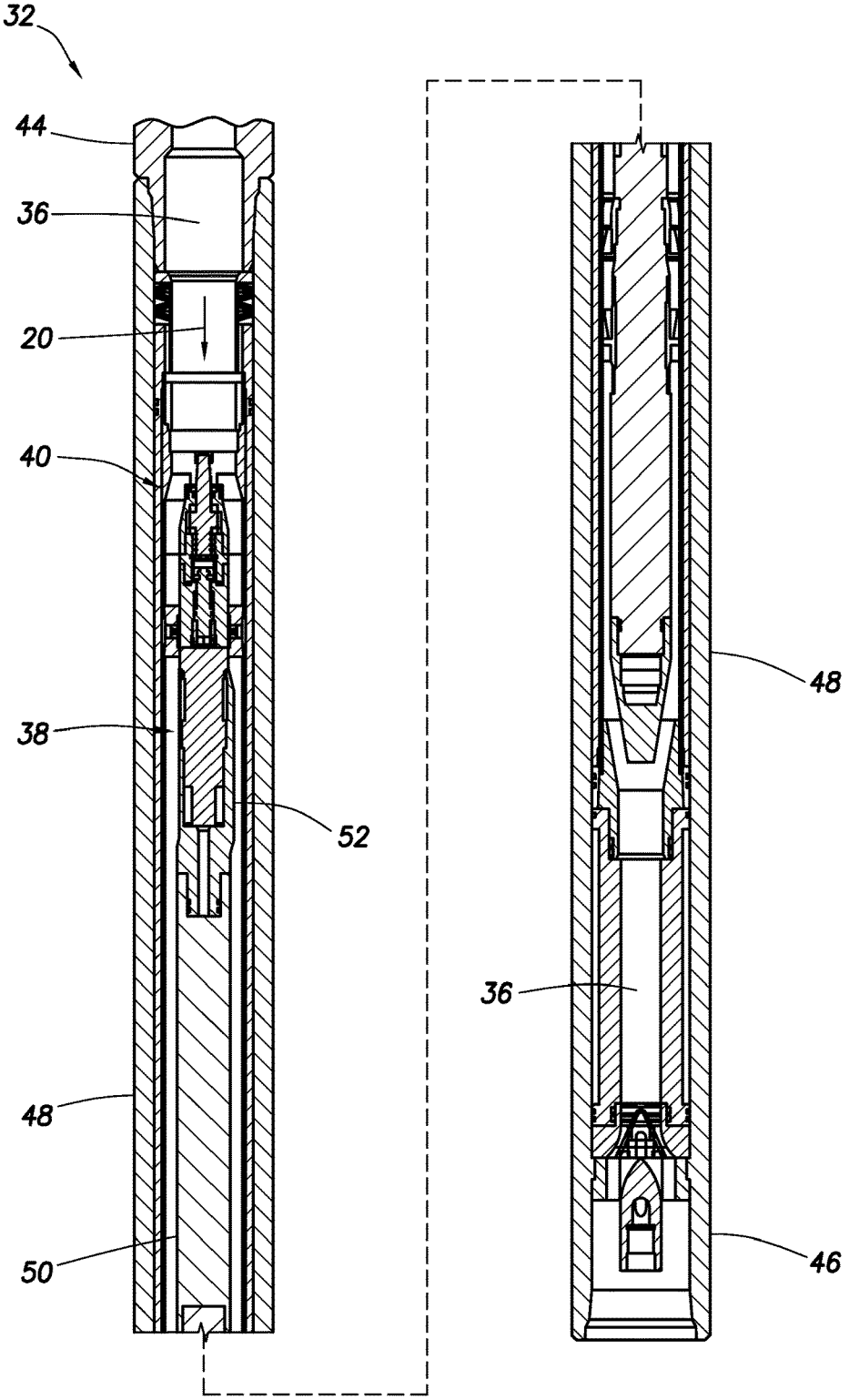
FIG. 2 is a representative cross-sectional view of a mud pulser which may be used in the system and method, and which can embody principles of this disclosure.

Referring additionally now to FIG. 2, an enlarged scale cross-sectional view of one example of the mud pulser 32 is representatively illustrated. The mud pulser 32 may be used in the system 10 and method of FIG. 1, or it may be used in other systems and methods.

Although the term "mud pulser" is understood by those skilled in the art to refer to tools which produce pressure fluctuations in fluid flowing through tubular strings for transmission of information, it should be clearly understood that it is not strictly necessary for the fluid 20 to be "mud."

Other types of fluids (such as, brine water, stimulation fluids, injection fluids, completion fluids, etc.) may be used in keeping with the scope of this disclosure.

In the FIG. 2 example, the mud pulser 32 includes upper and lower threaded connectors 44, 46 for interconnecting the mud pulser in the tubular string 16, although other types of tubular string connections may be used, if desired. A generally tubular outer housing 48 extends longitudinally between the connectors 44, 46 and contains the actuator 38 and variable flow restrictor 40.

The actuator 38 is a hydraulic actuator in this example. The actuator 38 produces displacement in response to application of pressure from a pump 50. A servo valve 52 is used to control application of pressure from the pump 50 to the actuator 38, although other types of flow control devices (e.g., solenoid valves, poppet valves, etc.) may be used, if desired.

Figure 3:
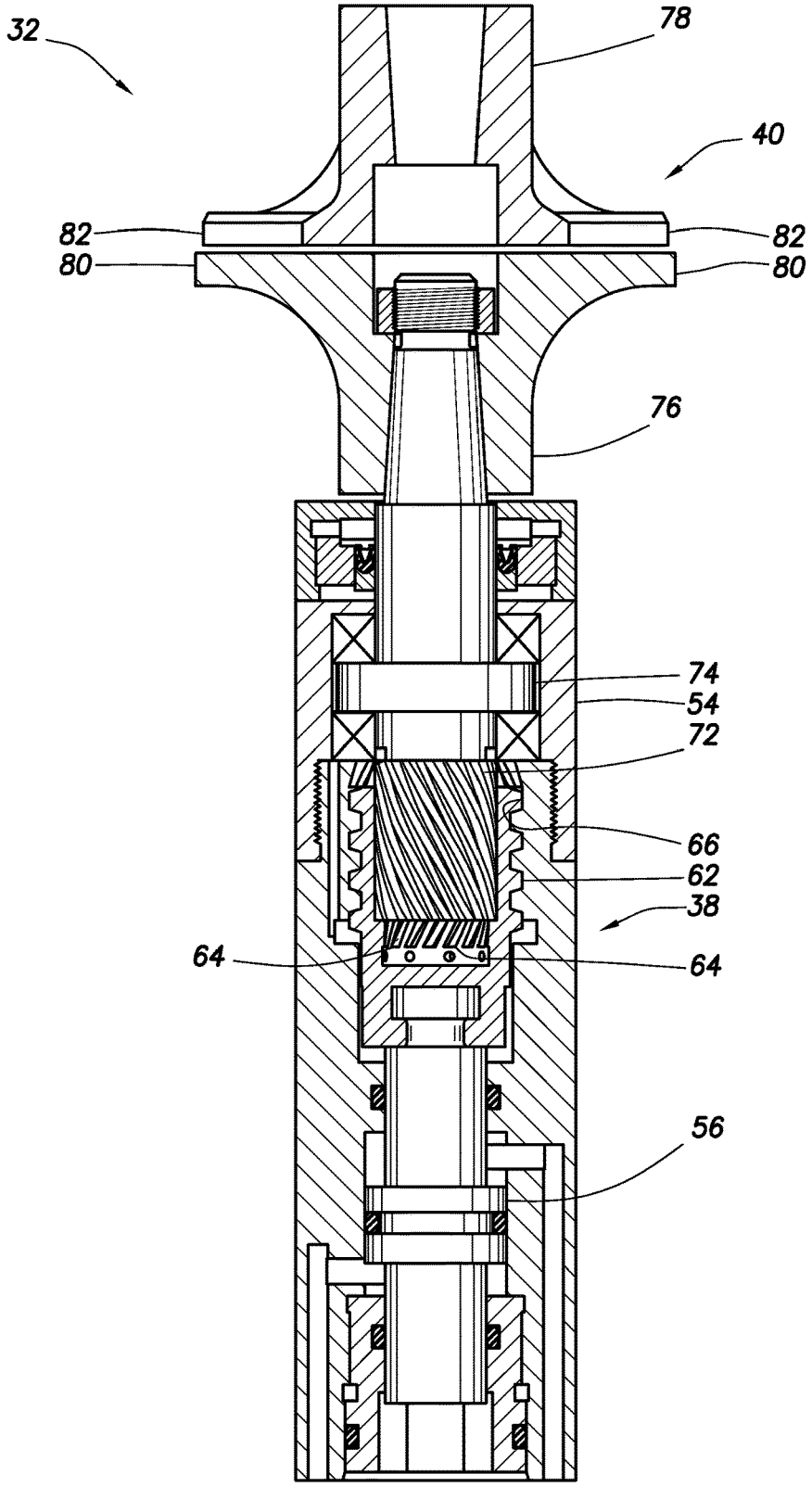
FIG. 3 is an enlarged scale representative partially cross-sectional view of an actuator which may be used in the mud pulser of FIG. 2, and which can embody principles of this disclosure.
Figure 4:
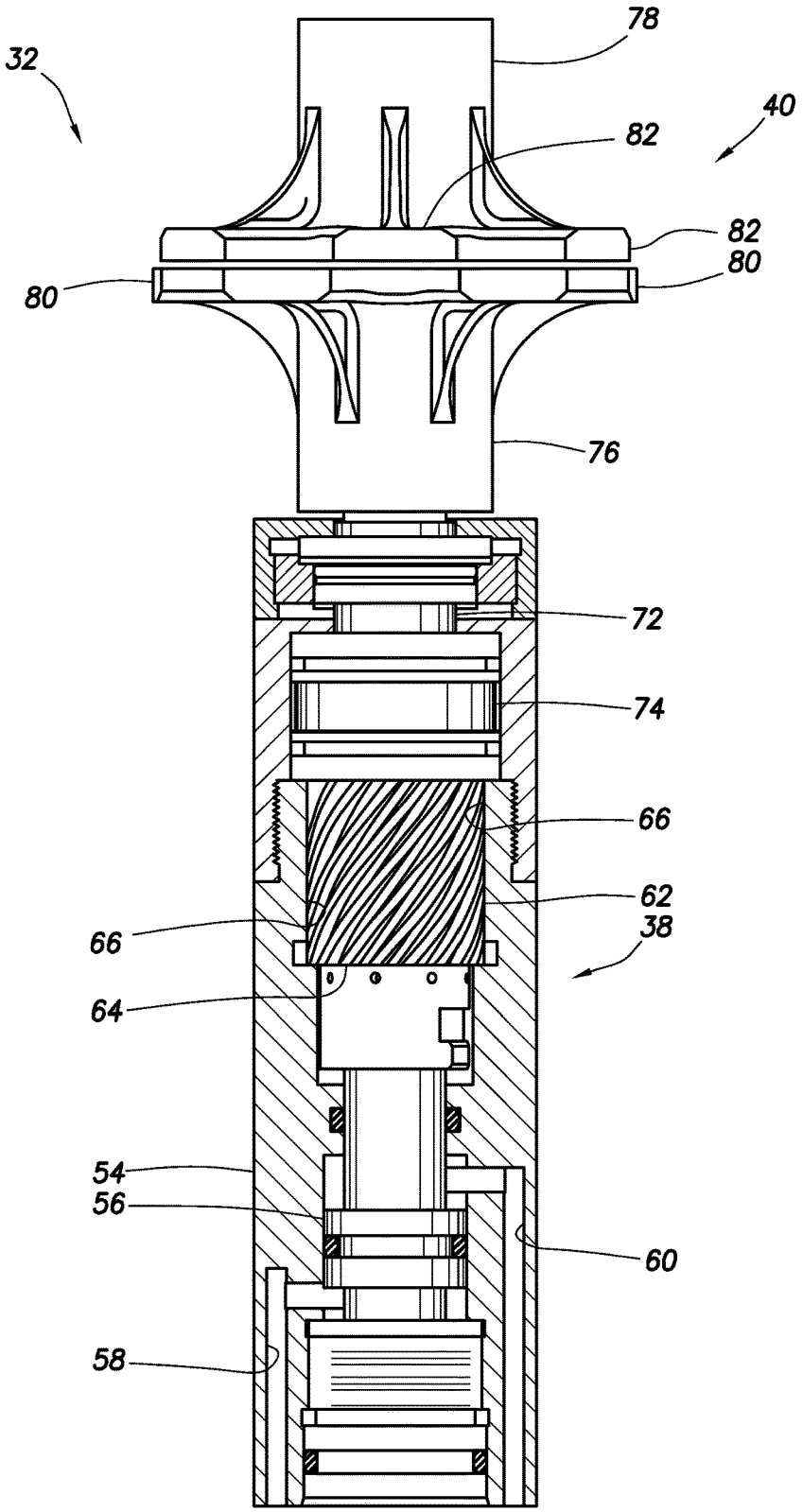
FIG. 4 is a representative perspective view of the actuator.

Referring additionally now to FIGS. 3 & 4, cross-sectional and perspective views of the actuator 38 and variable flow restrictor 40 are representatively illustrated, apart from the remainder of the mud pulser 32. The actuator 38 and/or flow restrictor 40 may be used with the mud pulser 32 of FIG. 2, or they may be used with other mud pulsers.

The actuator 38 includes a housing 54 having a piston 56 sealingly and reciprocably positioned therein. The piston 56 is displaced axially by pressure delivered from the servo valve 52 via passages 58, 60. A pressure differential between the passages 58, 60 is applied to the piston 56, causing the piston to displace upwardly or downwardly as viewed in FIG. 3.

The piston 56 is connected to an intermediate sleeve 62 by a slotted connection which allows the intermediate sleeve to rotate relative to the piston. Thus, as the piston 56 displaces the intermediate sleeve 62 axially, the intermediate sleeve can rotate, without the piston also rotating. However, in other examples, all or part of the piston 56 could rotate, if desired.

The intermediate sleeve 62 has external helical profiles 64 formed thereon, which engage complementary internal helical profiles 66 in the housing 54. The helical profiles 64, 66 are depicted in FIGS. 3 & 4 as being in the form of threads, but other types of helical profiles (e.g., ramps, splines, etc.) may be used, if desired.

The engagement between the helical profiles 64, 66 causes the intermediate sleeve 62 to rotate as it is displaced axially by the piston 56. It will be appreciated that the intermediate sleeve 62 will rotate in one direction when the piston 56 displaces in a corresponding axial direction, and the intermediate sleeve will rotate in an opposite direction when the piston displaces in an opposite axial direction.

Figure 6:
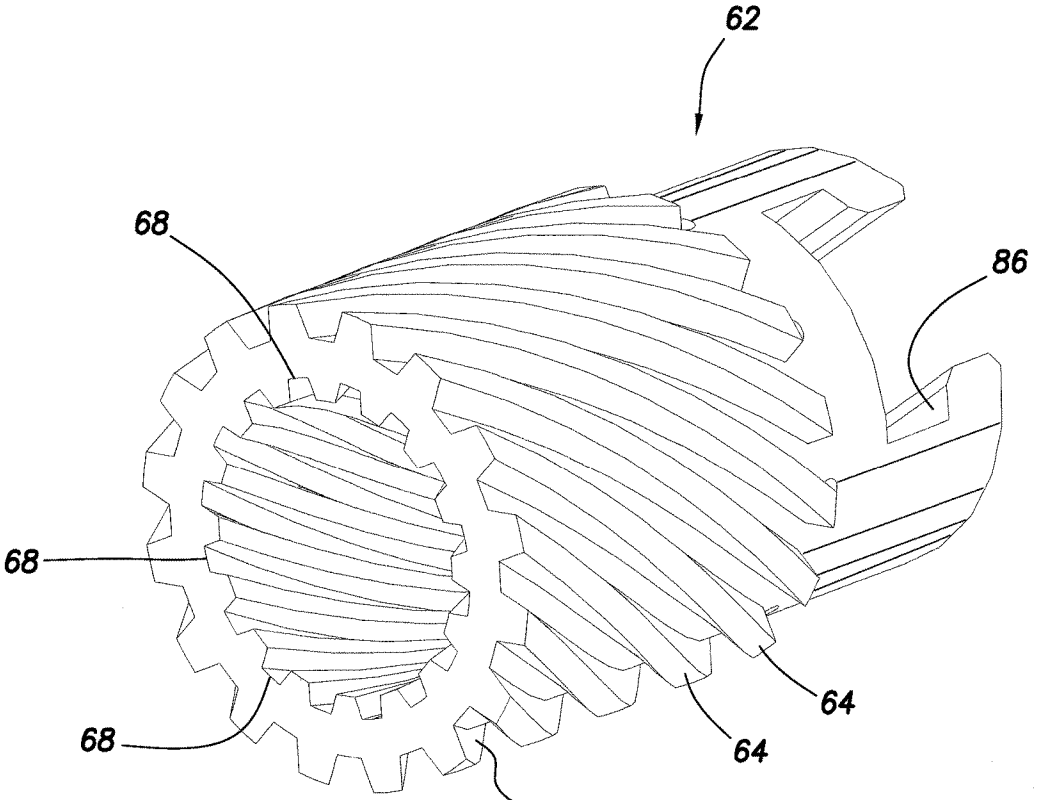
FIG. 6 is a representative perspective view of an intermediate sleeve of the actuator.
Figure 7:
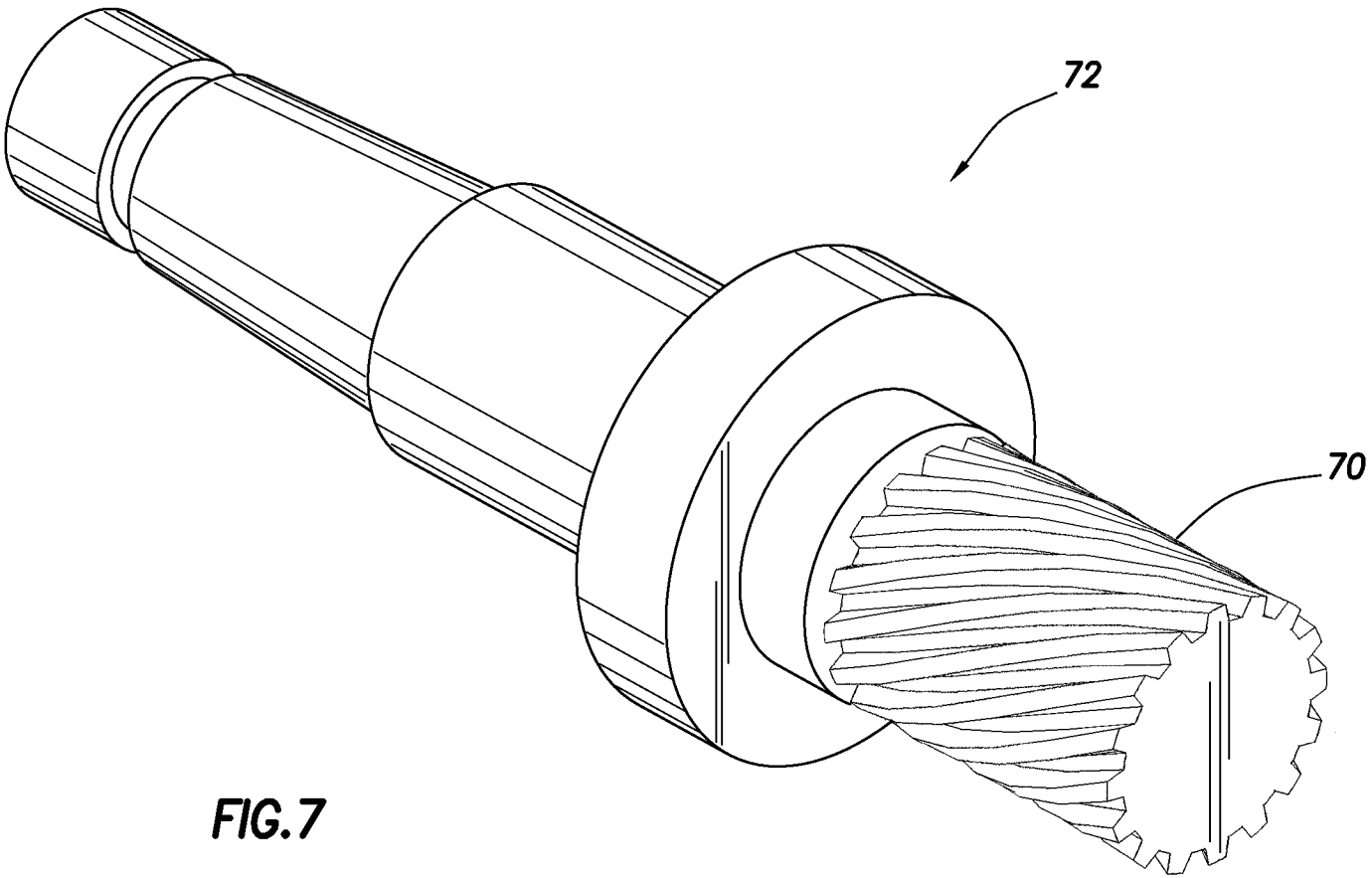
FIG. 7 is a representative perspective view of a shaft of the actuator.

The intermediate sleeve 62 also has internal helical profiles 68 (see FIG. 6) formed therein. The internal helical profiles 68 engage complementary external helical profiles 70 formed on an output member 72 (see FIG. 7). The output member 72 rotates in response to the rotation and axial displacement of the intermediate sleeve 62, due to the engagement between the helical profiles 68, 70.

The output member 72 is rotatably mounted in the housing 54 using bearings 74. The bearings 74 may include both radial and thrust bearings, or any suitable type of bearings which limit axial displacement of the output member 72, while permitting the output member to rotate relative to the housing 54.

It will be appreciated by those skilled in the art that the output member 72 will rotate at a greater speed (rotational velocity) than the intermediate sleeve 62, since the engagement between the helical profiles 68, 70 causes the output member 72 to rotate both in response to axial displacement of the intermediate sleeve, and in response to rotation of the intermediate sleeve. Thus, the actuator 38 can produce relatively fast rotations of the output member 72 in response to relatively small displacements of the piston 56. Small displacements of the piston 56 can be conveniently produced with relatively low power requirements for the pump 50 (and other components of a hydraulic power source).

The output member 72 is connected to a rotor 76 of the variable flow restrictor 40. Rotation of the rotor 76 relative to a stator 78 by the output member 72 varies a flow restriction in the flow passage 36.

In the FIGS. 3 & 4 example, the rotor 76 and stator 78 have respective radially extending vanes 80, 82 formed thereon. When the vanes 80, 82 are rotationally aligned, relatively little flow restriction is produced, but when the vanes are rotationally offset (as depicted in FIGS. 3 & 4), greater flow restriction is produced.

Thus, it will be appreciated that the pressure fluctuations 34 in the fluid 20 flowing through the flow passage 36 can be readily produced by alternately aligning and offsetting the vanes 80, 82 on the rotor 76 and stator 78. As discussed above, information can be modulated on the pressure fluctuations 34 with various modulation techniques, by using the actuator 38 to rotationally align and offset the vanes 80, 82 according to a pattern which corresponds to the chosen modulation technique (e.g., phase shift keying, frequency shift keying, differential pulse position modulation, etc.).

Note that it is not necessary for the vanes 80, 82 to be used for varying the flow restriction through the flow restrictor 40. In other examples, elements such as openings, movable plugs, or other types of flow restricting devices may be used.

Figure 5:
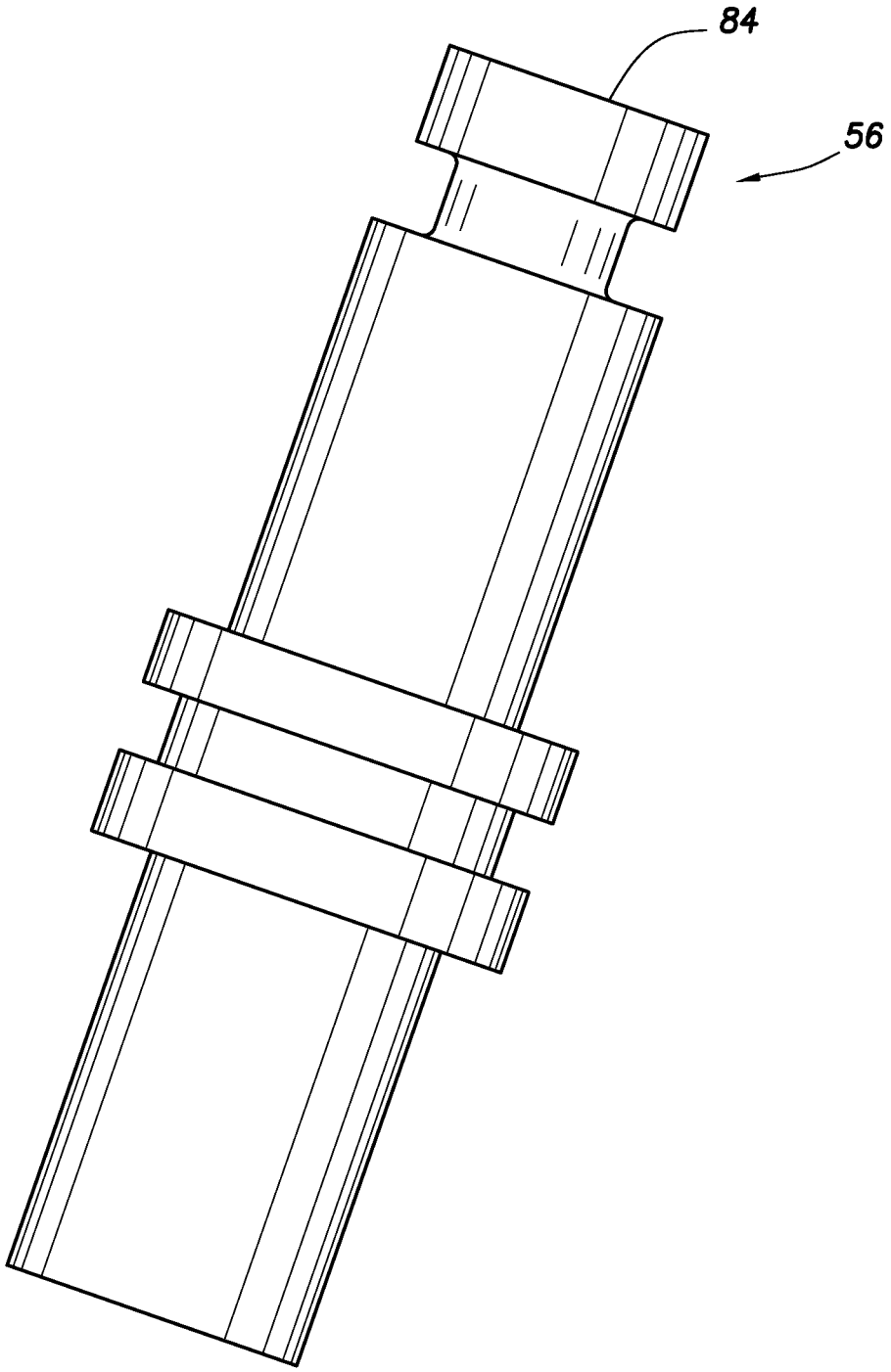
FIG. 5 is a representative side view of a piston of the actuator.

Referring additionally now to FIG. 5, the piston 56 is representatively illustrated apart from the remainder of the actuator 38. In this view, it may be clearly seen that a generally T-shaped engagement member 84 is formed on one end of the piston 56.

The member 84 engages a generally T-shaped slot 86 (see FIG. 6) formed on an end of the intermediate sleeve 62. The slot 86 is dimensioned to permit some rotation of the intermediate sleeve 62 relative to the piston 56, while the member 84 remains engaged in the slot, thereby allowing the piston to axially displace the intermediate sleeve as it rotates.

Figure 8:
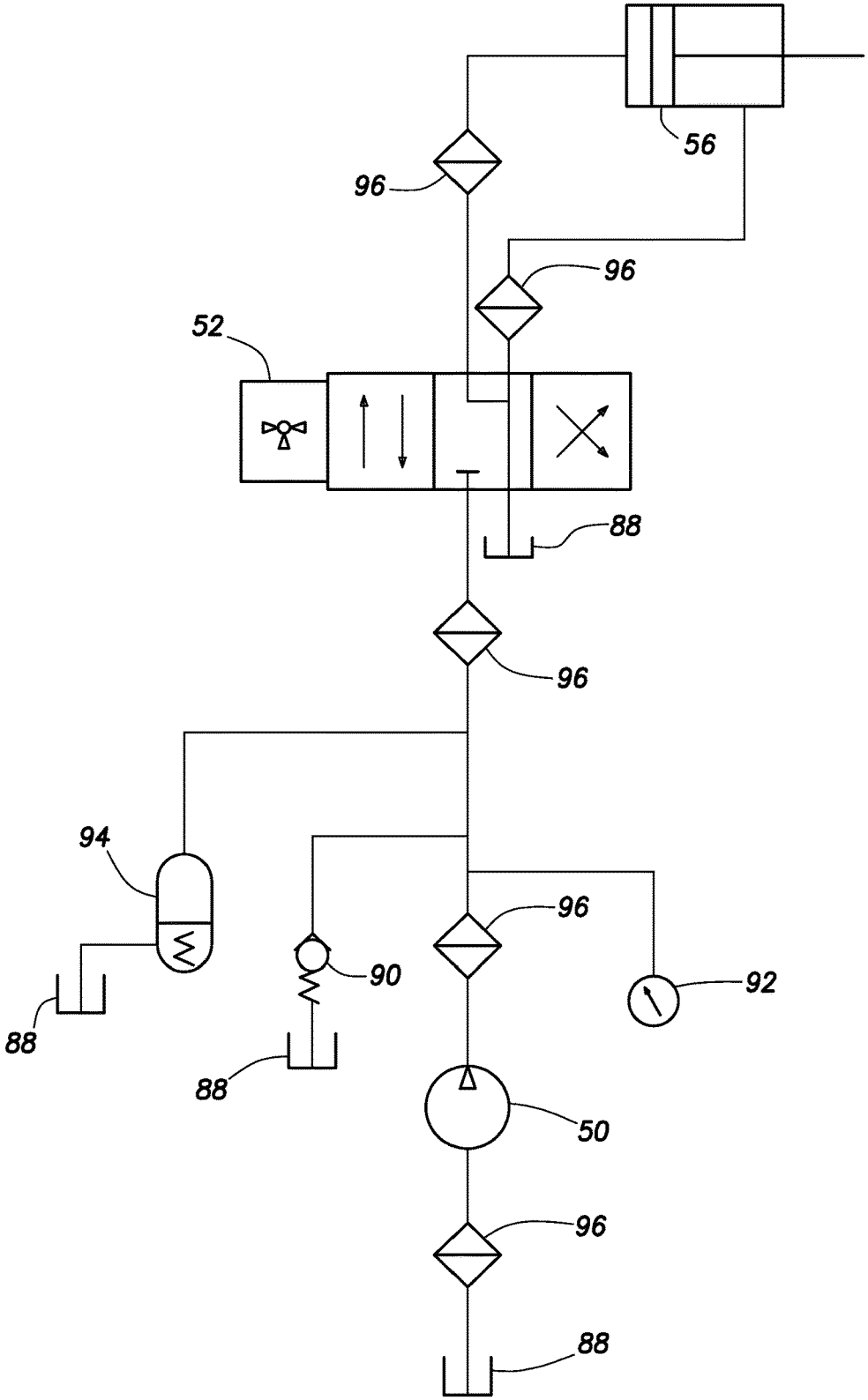
FIG. 8 is a schematic view of a hydraulic circuit for the actuator.

Referring additionally now to FIG. 8, an example of a hydraulic circuit diagram for the mud pulser 32 is representatively illustrated. In this view, it may be seen that the pump 50 delivers pressurized fluid to the servo valve 52, which controls application of the pressurized fluid to either side of the piston 56.

Various additional components (such as, a reservoir 88, a relief valve 90, a pressure sensor 92, an accumulator 94 and filters 96) are also depicted for the hydraulic circuit in FIG. 8. However, it should be clearly understood that the scope of this disclosure is not limited to any particular hydraulic components, or combination or arrangement thereof.

It may now be fully appreciated that the above disclosure provides significant advancements to the arts of constructing and operating mud pulsers, and otherwise modulating data on pressure fluctuations transmitted via tubular strings. In an example described above, the actuator 38 is capable of rapidly operating the variable flow restrictor 40, with relatively low hydraulic power requirements. This allows relatively fast data transmission rates via the pressure fluctuations 34 in the tubular string 16.

The above description provides to the art a mud pulser 32 for use with a subterranean well. In one example, the mud pulser 32 can comprise a variable flow restrictor 40 which restricts flow through the mud pulser 32, and an actuator 38 which operates the variable flow restrictor 40 and modulates information on pressure fluctuations 34 produced by the variable flow restrictor 40. The actuator 38 can include a piston 56 which displaces axially in response to a pressure differential across the piston 56, an intermediate sleeve 62 which is both rotated and displaced axially by the piston 56 displacement, and an output member 72 which is rotated by both rotation and axial displacement of the intermediate sleeve 62.

The piston 56 may not rotate as it displaces axially. The intermediate sleeve 62 may rotate relative to the piston 56 as the piston displaces axially.

The intermediate sleeve 62 can have internal and external helical profiles 68, 64 formed thereon. A helical profile 66 in a housing 54 containing the intermediate sleeve 62 may engage one of the intermediate sleeve internal and external helical profiles 68, 64. A helical profile 70 on the output member 72 may engage the other of the intermediate sleeve internal and external helical profiles 68, 64.

The output member 72 can be connected to the variable flow restrictor 40, whereby rotation of the output member 72 varies a flow restriction through the mud pulser 32.

The information modulated on the pressure fluctuations 34 may be received from a downhole sensor 26.

A system 10 for use with a subterranean well is also described above. In one example, the system 10 comprises a tubular string 16 in the well, a flow passage 36 extending longitudinally through the tubular string 16, and a mud pulser 32 interconnected in the tubular string 16 and operative to produce pressure fluctuations 34 in fluid flow through the flow passage 36. The mud pulser 32 can include an intermediate sleeve 62 which rotates in response to displacement of a piston 56, and an output member 72 which rotates in response to rotation of the intermediate sleeve 62, the output member 72 being connected to a variable flow restrictor 40 which variably restricts the flow through the flow passage 36.

The output member 72 may also rotate in response to axial displacement of the intermediate sleeve 62.

Also described above is a method of modulating information on pressure fluctuations 34 transmitted via a tubular string 16 in a subterranean well. In one example, the method can comprise: applying pressure to an actuator piston 56, thereby axially displacing the piston 56; axially displacing and rotating an intermediate sleeve 62 in response to the axial displacement of the piston 56; rotating an output member 72 in response to the axial displacement and rotation of the intermediate sleeve 62; and rotating a rotor 76 of a variable flow restrictor 40 relative to a stator 78 of the variable flow restrictor 40, the rotor 76 being connected to the output member 72.

The method can include positioning the variable flow restrictor 40 downhole.

The output member 72 rotating step can include rotating the output member 72 at a greater rotational speed as compared to the intermediate sleeve 62 rotating.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A mud pulser for use with a subterranean well, the mud pulser comprising:

a variable flow restrictor which restricts flow through the mud pulser; and an actuator which operates the variable flow restrictor and modulates information on pressure fluctuations produced by the variable flow restrictor, the actuator including:

a housing, a piston which displaces axially in response to a pressure differential across the piston, an intermediate sleeve engaged with the housing, the intermediate sleeve being separate from and rotatably connected to the piston so as to axially displace in response to the piston displacement and rotate in response to the intermediate sleeve being engaged with the housing, and an output member which is rotated by both the rotation and axial displacement of the intermediate sleeve.

2. The mud pulser of claim 1, wherein the piston does not rotate as the piston displaces axially.

3. The mud pulser of claim 1, wherein the intermediate sleeve rotates relative to the piston as the piston displaces axially.

4. The mud pulser of claim 1, wherein the intermediate sleeve has internal and external helical profiles formed thereon.

5. The mud pulser of claim 4, wherein the housing contains the intermediate sleeve, and a helical profile of the housing engages one of the intermediate sleeve internal and external helical profiles.

6. The mud pulser of claim 5, wherein an additional helical profile formed on the output member engages the other of the intermediate sleeve internal and external helical profiles.

7. The mud pulser of claim 1, wherein the output member is connected to the variable flow restrictor, whereby rotation of the output member varies a flow restriction through the mud pulser.

8. The mud pulser of claim 1, wherein the information is received from a downhole sensor.

9. A system for use with a subterranean well, the system comprising:

a tubular string in the well, a flow passage extending longitudinally through the tubular string; and a mud pulser interconnected in the tubular string and operative to produce pressure fluctuations in fluid flow through the flow passage, the mud pulser comprising:

a housing;

a piston which axially displaces in response to a pressure differential across the piston, an intermediate sleeve engaged with the housing, the intermediate sleeve being separate from and rotatably connected to the piston so as to rotate the intermediate sleeve in response to displacement of the piston and engagement between the intermediate sleeve and the housing, and an output member which rotates in response to the rotation of the intermediate sleeve, the output member being connected to a variable flow restrictor which variably restricts the flow through the flow passage.

10. The system of claim 9, wherein the piston does not rotate as the piston displaces.

11. The system of claim 9, wherein the intermediate sleeve rotates relative to the piston as the piston displaces.

12. The system of claim 9, wherein the intermediate sleeve has internal and external helical profiles formed thereon.

13. The system of claim 12, wherein the housing contains the intermediate sleeve, and the helical profile engages one of the intermediate sleeve internal and external helical profiles.

14. The system of claim 13, wherein an additional helical profile formed on the output member engages the other of the intermediate sleeve internal and external helical profiles.

15. The system of claim 9, wherein the variable flow restrictor modulates information on the pressure fluctuations.

16. The system of claim 15, wherein the information is received from a downhole sensor.

17. The system of claim 9, wherein the output member additionally rotates in response to axial displacement of the intermediate sleeve.

18. A method of modulating information on pressure fluctuations transmitted via a tubular string in a subterranean well, the method comprising:

applying pressure to an actuator piston, thereby axially displacing the piston;

axially displacing and rotating an intermediate sleeve separate from and rotatably connected to the piston in response to the axial displacement of the piston and the intermediate sleeve being engaged with a housing;

rotating an output member in response to the axial displacement and the rotation of the intermediate sleeve; and rotating a rotor of a variable flow restrictor relative to a stator of the variable flow restrictor, the rotor being connected to the output member.

19. The method of claim 18, wherein the piston does not rotate as the piston displaces axially.

20. The method of claim 18, wherein the intermediate sleeve rotates relative to the piston as the piston displaces axially.

21. The method of claim 18, wherein the intermediate sleeve has internal and external helical profiles formed thereon.

22. The method of claim 21, wherein the housing contains the intermediate sleeve, and a helical profile of the housing engages one of the intermediate sleeve internal and external helical profiles.

23. The method of claim 22, wherein an additional helical profile formed on the output member engages the other of the intermediate sleeve internal and external helical profiles.

24. The method of claim 18, wherein the rotation of the rotor relative to the stator varies a flow restriction through the variable flow restrictor.

25. The method of claim 18, further comprising receiving the information from a downhole sensor.

26. The method of claim 18, further comprising positioning the variable flow restrictor downhole.

27. The method of claim 18, wherein the output member rotating further comprises rotating the output member at a greater rotational speed as compared to the intermediate sleeve rotating.

* * * * *